US008584906B2

(12) United States Patent
Houghton et al.

(10) Patent No.: US 8,584,906 B2
(45) Date of Patent: Nov. 19, 2013

(54) DISPENSER PUMP HEAD FOR CONTROLLING MISDIRECTION

(75) Inventors: Weston R. Houghton, Stow, OH (US); Estella Allen, Stow, OH (US); Eugene W. Ray, Barberton, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 13/600,743

(22) Filed: Aug. 31, 2012

(65) Prior Publication Data

US 2012/0325863 A1 Dec. 27, 2012

Related U.S. Application Data

(63) Continuation of application No. 11/977,287, filed on Oct. 24, 2007, now abandoned.

(51) Int. Cl.
*B65D 88/54* (2006.01)

(52) U.S. Cl.
USPC ..... 222/321.9; 222/571; 222/575

(58) Field of Classification Search
USPC ..... 222/321.1, 321.3, 321.9, 571, 575; D9/448
See application file for complete search history.

(56) References Cited

U.S. PATENT DOCUMENTS

| | | | | |
|---|---|---|---|---|
| 3,352,463 | A * | 11/1967 | Berler | 222/321.3 |
| 4,887,744 | A | 12/1989 | Williams | |
| 4,938,384 | A | 7/1990 | Pilolla et al. | |
| 5,326,237 | A | 7/1994 | Cecil et al. | |
| 5,868,286 | A * | 2/1999 | Mascitelli | 222/321.9 |
| 6,227,416 | B1 * | 5/2001 | Lee | 222/321.7 |
| 2002/0179650 | A1 * | 12/2002 | Mascitelli | 222/494 |

* cited by examiner

*Primary Examiner* — Kevin P Shaver
*Assistant Examiner* — Daniel R Shearer
(74) *Attorney, Agent, or Firm* — Renner Kenner Greive Bobak Taylor & Weber

(57) ABSTRACT

A pump head for a displacement pump used in a bottle dispenser and configured to minimize misdirection of solution dispensed through an orifice thereof. The pump head is an integrally molded one piece structure, having an elliptical outlet orifice that lies in a substantially horizontal plane, and having a major axis substantially twice that of the minor axis. The configuration and the positioning of the orifice minimizes clogging or coagulation of certain solutions, obscures such coagulation from view, and minimizes the misdirection of any dispensing through the nozzle orifice that would otherwise result from clogging or coagulation. The pump head is particularly adapted for use with displacement pumps employed in bottle dispensers and the like.

5 Claims, 2 Drawing Sheets

DISPENSER PUMP HEAD FOR CONTROLLING MISDIRECTION

CROSS-REFERENCE TO RELATED APPLICATION

This application is a Continuation of U.S. patent application Ser. No. 11/977,287 filed on Oct. 24, 2007 now abandoned, which is incorporated herein by reference in its entirety.

TECHNICAL FIELD

The invention herein resides in the art of dispensers intended for use for dispensing solutions of various types. More particularly, the invention relates to a pump head for a displacement pump employed in such dispensers. Specifically, the invention relates to a pump head for a displacement pump utilized in a bottle dispenser and configured to minimize clogging or coagulating of the dispensing orifice in order to control misdirection of the dispensed solution.

BACKGROUND ART

The use of dispensers for dispensing solutions of various types is now widely known. Various soaps, antimicrobial solutions, cleaners and the like are now routinely provided in bottles having hand operated displacement pumps associated therewith and particularly adapted and configured to dispense the solution within the bottle into the defined area in which a user's hand is placed. Many solutions that are dispensed from such bottles are of sufficiently thin viscosity and consistency that the orifice through which they are dispensed typically remains clear and unobstructed from one dispensing operation to the next. Accordingly, the flow of the dispensed solution is typically predictable and consistent, and not given to misdirection that might cause the solution to hit something other than its intended target.

Presently, many antimicrobial solutions are alcohol based and include a polymeric thickener such as a carbomer, increasing the viscosity of the solution into a gelatious fluid. After a dispensing operation, the residual of the solution that remains at the dispensing orifice often coagulates or tends to harden because of the presence of the polymeric thickener and the evaporation of the water and alcohol components of the solution. When this happens, the output orifice of the dispenser clogs to some degree, changing the orifice geometry, defining a deflection area at the orifice, and generally changing the projection of solution emitted therefrom. As a consequence, the dispensing of such solutions from a standard dispenser nozzle often result in misdirection of the dispensed material.

Moreover, because the prior art dispensing orifices have typically been vertically oriented, any resultant misdirection of the solution could cause the solution to be dispensed upon the user's clothing, face, or other body parts, rather than the hand, as intended. The results are simply unsatisfactory. Misdirection of solution that reaches other than the user's hand is certainly not appreciated by the user. Moreover, in previously known dispensers, the actual clog or coagulated material has a displeasing appearance, inconsistent with the cleanliness and sanitation intended by the solution itself.

There is a need in the art for a pump head for use with a displacement pump and a bottle dispenser, that may be used with solutions having a tendency to clog or coagulate in the dispensing nozzle, that is configured such as to control or limit any misdirection of dispensing resulting from the coagulation. There is also a need in the art for such a pump head that minimizes the size of any clog or coagulated solution to provide for aesthetic acceptability. There is still a further need in the art for such a pump head for use with a displacement pump in a bottle dispenser that is simple in construction, cost effective in implementation, and readily adapted for use with presently existing bottle dispensers.

DISCLOSURE OF INVENTION

In light of the foregoing, it is a first aspect of the invention to provide a pump head for a displacement pump in a bottle dispenser in which the output orifice is downwardly directed.

Another aspect of the invention is the provision of a pump head for a displacement pump in a bottle dispenser in which the orifice is configured to minimize clogs and coagulation.

A further aspect of the invention is the provision of a pump head for a displacement pump in a bottle dispenser in which the output orifice is geometrically configured to restrict and confine any misdirected dispensing into an acceptable target range.

Still a further aspect of the invention is the provision of a pump head for a displacement pump in a bottle dispenser that limits the frequency, intensity and type of misdirection of the dispensed solution, while being readily adapted for implementation with existing pumps and bottle dispensers.

The foregoing and other aspects of the invention that will become apparent as the detailed description proceeds are achieved by a pump head for a displacement pump, comprising: a body; an actuator pad on said body for engagement by a user; a bore within said body adapted for engagement with a displacement pump, said bore having a central axis; a nozzle plane at an end of said body, said nozzle plane being substantially perpendicular to said central axis; an orifice defined within said nozzle plane; and a passage extending between said bore and said orifice.

Other aspects of the invention that will become apparent herein are achieved by a solution dispenser, comprising: a bottle; a displacement pump received within said bottle; a pump head secured to said bottle and operatively connected to said displacement pump, said pump head comprising: a body; an actuator pad on said body for engagement by a user; a bore within said body adapted for engagement with said displacement pump, said bore having a central axis; a nozzle plane at an end of said body, said nozzle plane being substantially perpendicular to said central axis; an orifice defined within said nozzle plane; and a passage extending between said bore and said orifice.

DESCRIPTION OF DRAWINGS

For a complete understanding of the various aspects, structures and techniques of the invention, reference should be made to the following detailed description and accompanying drawings wherein.

BEST MODE FOR CARRYING OUT THE INVENTION

Figure 1:
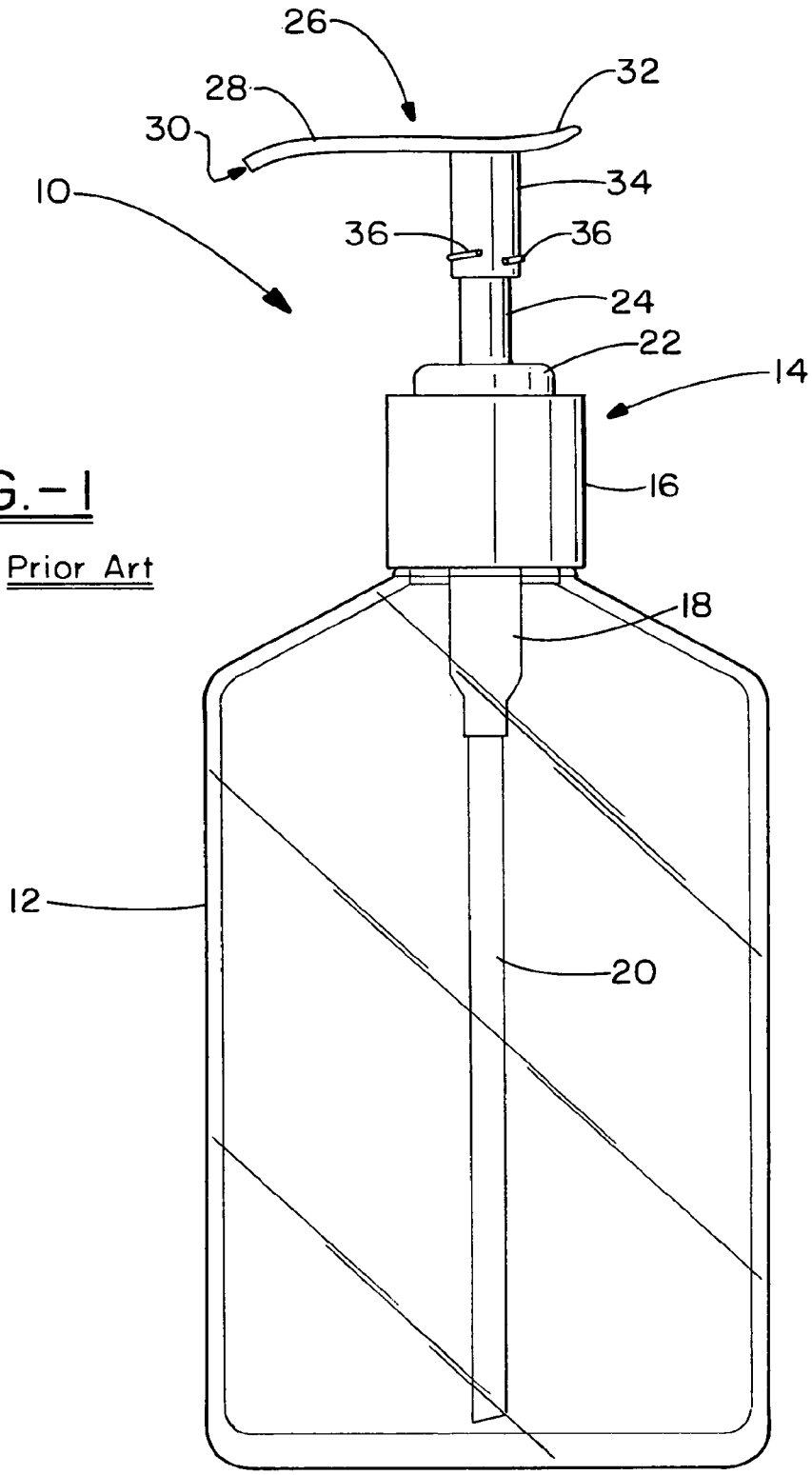
FIG.-1 Prior Art
FIG. 1 is a front elevational view of a bottle dispenser of the type employed with the invention herein, showing a pump head of the type employed in the prior art.
Figure 2:
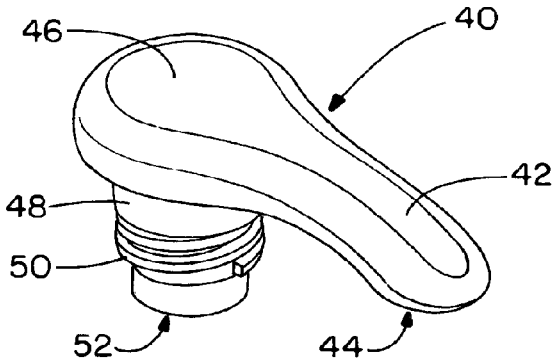
FIG. 2 is a perspective view of a pump head made in accordance with the invention.
Figure 3:
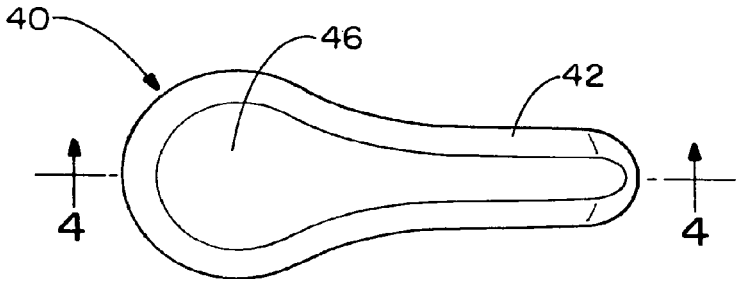
FIG. 3 is a top plan view of the pump head of FIG. 2.

Referring now to the drawings and more particularly FIG. 1, it can be seen that a bottle dispenser of the type of interest herein is designated generally by the numeral 10. The bottle dispenser 10 includes a bottle or container 12, typically of a suitable glass, plastic material or the like. As shown here, such bottles or containers 12 are often made of a transparent material. A pump mechanism assembly 14 is received by the neck of the bottle 12 and is secured therein by means of a cap 16 threaded to the neck. A displacement pump 18 comprises a major portion of the pump mechanism assembly 14 and has extending therefrom a dip tube 20 that extends to the bottom of the bottle or container 12. As shown, the bottom of the dip tube 20 is typically cut on an angle or bias in order to ensure maximum retrieval of the solution within the bottle.

As shown, a collar 22 is positioned at the top of the cap 16, with a hollow pump shaft or stem 24 extending therethrough. A pump head assembly 26 receives the hollow pump shaft or stem 24, as shown.

As will be appreciated by those skilled in the art, a pump head assembly 26 typically includes a nozzle 28 having a nozzle orifice or opening 30 at an extreme end thereof. An actuator pad or surface 32 is provided for engagement by a user's finger, thumb, or hand in order to actuate the displacement pump for the dispensing of solution. A neck 34 extends downwardly from the main portion of the nozzle 28 and is provided with threads 36 thereabout. The threads 36 are adapted to mate with threads maintained within the collar 22 in order to prevent operation of the pump during shipment, transport, periods of non-use, and the like.

With continued reference to FIG. 1, those skilled in the art will appreciate that downward force on the actuator pad or surface 32 actuates the displacement pump 18 to cause solution to be drawn through the dip tube 20, pump 18, hollow stem 24, neck 34, nozzle 28, and out of the nozzle orifice or opening 30. The prior art orifice or opening 30 was, as shown, substantially vertically oriented, departing from a vertical plane only on the order of 20°-40°. However, as discussed above, when the orifice 30 would clog in such a device, the dispensed solution would then typically be misdirected to such a degree as to impinge upon the user's clothes, face, or other body parts that were unintended for such a deposit. This misdirection tendency is aggravated by the fact that clog or coagulation of solution typically occurs at the bottom or lowermost part of the orifice 30, having the tendency to deflect the solution upwardly upon a dispensing operation. Moreover, with the substantially vertical orientation of the plane of the orifice 30, any clogs or coagulation are typically apparent to the user and are unsightly and inconsistent with the desired sanitary implication of such dispensers.

Referring now to FIGS. 2-5, it can be seen that a pump head assembly made in accordance with the invention is designated by the numeral 40 and comprises a body having a nozzle portion 42, a nozzle orifice or opening 44, an actuator pad or surface 46, and a neck portion 48 having a plurality of threads 50 thereabout. In sum, the pump head 40 is intended for direct substitution and replacement of the pump head assembly 26 shown in FIG. 1.

Figure 4:
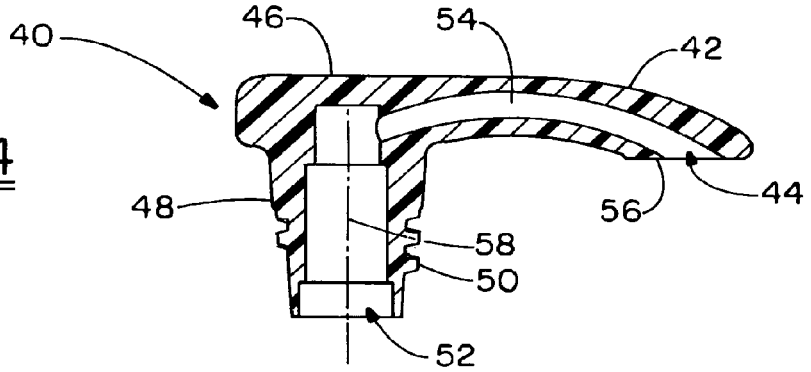
FIG. 4 is a cross sectional view of the pump head of FIGS. 2 and 3, taken along the line 4-4 in FIG. 3.

As best seen in FIG. 4, a stepped bore 52 is present within the neck 48 and is adapted to receive the pump shaft or stem 24 therein. As presented above, the pump shaft or stem 24 is connected to the displacement pump 18 which, in turn, is connected to the dip tube 20.

An arcuate passage 54 extends between the bore 52 and the nozzle orifice or opening 44, as shown. The arcuate passage 54 intersects the plane 56, thereby defining the nozzle orifice 44. In the context of the invention, the plane 56 is substantially horizontal when the bottle dispenser is set upright on a horizontal surface. In other words, the plane 56 is perpendicular to the central axis 58 of the bore 52. While in the prior art, the plane of the outlet orifice departed from the vertical plane on the order of 20°-40°, the instant invention contemplates that the orifice 44 will lie within a plane 56 that is substantially horizontal and substantially perpendicular to the axis 58 of the bore 52. Accordingly, the dispensing by the displacement pump and through the arcuate passage 54 and out of the orifice 44 is directed downwardly despite any clog or coagulation and it has been found that any misdirection that might result from an incident clog or the like will stay within a cone of acceptance to reach a person's hand placed within approximately 2-4 inches thereof.

According to the invention, the pump head assembly 40 of the invention is preferably injection molded of polypropylene. As mentioned above, the passage 54 is arcuate, having a fixed radius on the order of 25-29 mm, and preferably 27 mm. The arcuate pin used to form the passage 54 has a draft or taper to it, having a diameter on the order of 2.3 mm near the intersection with bore 52, and on the order of 2.6 mm adjacent to the orifice 44. The draft or taper is uniform therebetween, such that the passage 54 is of a tapered circular cross-sectioned configuration.

Figure 5:
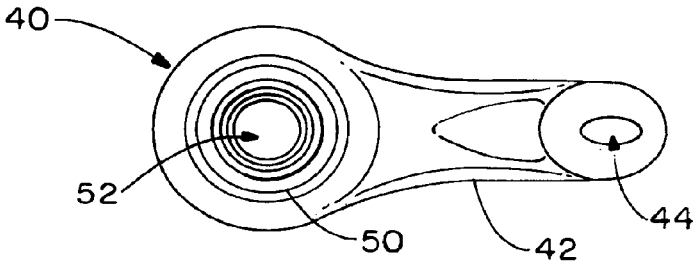
FIG. 5 is a bottom plan view of the pump head of FIG. 2.

The orifice 44 is elliptical, as shown in FIG. 5. This is primarily the result of the intersection of the arcuate passage 54 of the radius described above, with the planar surface 56. The elliptical orifice 44 has a major axis on the order of 5.34 mm and a minor axis of 2.73 mm. It has been found that with the orifice 44 having an elliptical configuration and of about the size just described, and further with the major axis being approximately double the minor axis, the tendency for clogs and coagulation at the orifice has been reduced. Moreover, with the planar surface 56 being substantially horizontal, any coagulations or clogs are substantially obscured from sight, rendering a more aesthetically pleasing presentation.

Thus it can be seen that the various aspects of the invention have been satisfied by the structure presented above. An integrally molded pump head assembly having a substantially vertically oriented dispensing orifice of elliptical configuration as described above has been found to limit resultant misdirection of the dispensing of solution, minimize the coagulation incident to the dispensing orifice, conceal the coagulation from sight, and ensure that dispensing hits a reasonable target without the likelihood of gross misdirection. While in accordance with the patent statutes, only the best mode and preferred embodiment of the invention has been presented and described in detail, the invention is not limited thereto or thereby.

Accordingly, for a true appreciation of the scope and breadth of the invention reference should be made to the following claims.

What is claimed is:

1. A pump head for a displacement pump, comprising:

a body;

an actuator pad on said body for engagement by a user;

a bore within said body adapted for engagement with a displacement pump, said bore having a central axis;

a nozzle plane at an end of said body, said nozzle plane being substantially perpendicular to said central axis;

a geometrically elliptical orifice defined within said nozzle plane and having a major and a minor axis, said major axis being substantially twice that of said minor axis; and an arcuate passage extending upwardly from said bore and then downwardly to termination at said nozzle plane, said passage being circular in cross-section and uniformly expanding cross-sectionally from said bore to its termination at said elliptical orifice, said termination of said arcuate passage at said nozzle plane defining said elliptical orifice.

2. The pump head as recited in claim 1, wherein the arcing of said passage has a fixed radius.

3. The pump head as recited in claim 1, wherein said major axis of said orifice intersects said axis of said bore.

4. The pump head as recited in claim 3, wherein said body is a unitary body molded of polypropylene.

5. The pump head as recited in claim 4, wherein said body is threaded about a portion of said bore.

* * * * *